US006244844B1

(12) United States Patent
Diaz

(10) Patent No.: US 6,244,844 B1
(45) Date of Patent: Jun. 12, 2001

(54) FLUID DISPLACEMENT APPARATUS WITH IMPROVED HELICAL ROTOR STRUCTURE

(75) Inventor: Daniel Joseph Diaz, Statesboro, GA (US)

(73) Assignee: Emerson Electric Co., St. Louis, MO (US)

( * ) Notice: Subject to any disclaimer, the term of this patent is extended or adjusted under 35 U.S.C. 154(b) by 0 days.

(21) Appl. No.: 09/283,118

(22) Filed: Mar. 31, 1999

(51) Int. Cl.[7] ..... F03C 2/00
(52) U.S. Cl. ..... 418/201.3; 418/2; 73/261
(58) Field of Search ..... 418/201.3, 2; 73/261

(56) References Cited

U.S. PATENT DOCUMENTS

| | | | | |
|---|---|---|---|---|
| 1,191,423 | | 7/1916 | Holdaway . | |
| 1,233,599 | * | 7/1917 | Nuebling | 418/201.1 |
| 1,821,523 | | 9/1931 | Montelius . | |
| 2,079,083 | | 5/1937 | Montelius . | |
| 2,511,878 | | 6/1950 | Rathman . | |
| 2,799,253 | * | 7/1957 | Lindhagen et al. | 418/201.1 |
| 2,804,260 | * | 8/1957 | Nilsson et al. | 418/201.1 |
| 3,535,057 | * | 10/1970 | Kobra | 418/201.1 |
| 3,633,420 | * | 1/1972 | Holzem | 73/199 |
| 3,807,911 | * | 4/1974 | Caffrey | 418/201.1 |

(List continued on next page.)

FOREIGN PATENT DOCUMENTS

| | | | | |
|---|---|---|---|---|
| 2931679 | * | 2/1981 | (DE) | 418/201.3 |
| 3502839 | * | 7/1986 | (DE) | 418/201.3 |
| 2684417 | * | 6/1993 | (FR) | 418/201.1 |
| 112 104 | | 1/1918 | (GB) . | |
| 3-160183 | * | 7/1991 | (JP) | 418/201.1 |

OTHER PUBLICATIONS

International Search Report, PCT/US00/06375, Jul. 20, 2000.
Declaration of Wilford John Parrish, Jr., Feb. 10, 2000.

*Primary Examiner*—Thomas Denion
*Assistant Examiner*—Theresa Trieu
(74) *Attorney, Agent, or Firm*—Myers Bigel Sibley & Sajoec

(57) ABSTRACT

A fluid displacement apparatus includes a housing defining a chamber therein having a first port and a second port. First and second helical rotors with opposing pitches are meshed within the chamber, in fluid communication with the first and second ports. A respective one of the first and second helical rotors includes a cylindrical body portion having a helical groove therein and a helical tooth portion extending radially from the cylindrical body portion adjacent the helical groove. The first and second helical rotors are arranged such that respective longitudinal axes of the first and second helical rotors are parallel to one another and a helical tooth portion of one of the first and second helical rotors engages a helical groove of another of the first and second helical rotors, such that the first and second helical rotors are operative to rotate within the chamber and provide fluid transport between the first and second ports parallel to the longitudinal axes. A respective one of the first and second helical rotors has a first tooth surface lying within the helical groove and extending onto the helical tooth portion and a second tooth surface extending from the cylindrical body portion onto the helical tooth portion opposite the first tooth surface. The first tooth surface preferably includes an epitrochoid-derived surface, i.e., a surface defining an epitrochoid curve in radial cross section. The second tooth surface preferably includes an epicycloid-derived surface, i.e., a surface defining an epicycloid curve in radial cross section.

28 Claims, 7 Drawing Sheets

U.S. PATENT DOCUMENTS 3,841,805 * 10/1974 Zalis ..... 418/201.1
3,910,731 * 10/1975 Persson et al. ..... 418/201.1
3,950,986 * 4/1976 Parkinson ..... 73/136
4,020,642 * 5/1977 Haselden et al. ..... 418/201.1
4,078,653 3/1978 Suter .
4,119,392 * 10/1978 Breckheimer ..... 418/201.1
4,145,168 * 3/1979 Smith, Jr. et al. ..... 418/150
4,345,480 * 8/1982 Basham et al. ..... 73/861.77
4,405,286 9/1983 Studer .
4,412,796 * 11/1983 Bowman ..... 418/201
4,450,806 * 5/1984 Miura et al. ..... 123/401
4,714,418 * 12/1987 Matsubara et al. ..... 418/201
4,797,068 * 1/1989 Hayakawa et al. ..... 418/201.1
5,080,636 * 1/1992 Weber ..... 475/14
5,120,208 * 6/1992 Toyoshima et al. ..... 418/201.1
5,135,374 * 8/1992 Yoshimura et al. ..... 418/201.1
5,182,953 * 2/1993 Ellinger et al. ..... 73/862.335
5,447,062 9/1995 Köpl et al. .
5,704,767 * 1/1998 Johnson ..... 418/2

* cited by examiner

FLUID DISPLACEMENT APPARATUS WITH IMPROVED HELICAL ROTOR STRUCTURE

FIELD OF THE INVENTION

The present invention relates to fluid displacement apparatus, and more particularly, to fluid displacement apparatus employing helical rotors.

BACKGROUND OF THE INVENTION

Helical-rotor fluid displacement apparatus, such as screw pumps and helical-rotor volumetric flow meters, have been used for many years. Generally, such apparatus include one or more helical rotors arranged within a conformal chamber having an input port and an output port. The rotor (or rotors) and an inner surface of the chamber typically define a displacement volume that moves along the axis of the rotor as the rotor turns, thus moving fluid from one port of the chamber to another.

Many variations on this basic design have been proposed. For example, U.S. Pat. No. 1,191,423 to Holdaway, U.S. Pat. No. 1,233,599 to Nuebling, U.S. Pat. No. 1,821,523 to Montelius, U.S. Pat. No. 2,079,083 to Montelius, U.S. Pat. No. 2,511,878 to Rathman, U.S. Pat. No. 4,078,653 to Suter, U.S. Pat. No. 4,405,286 to Studer and U.S. Pat. No. 5,447,062 to Kopl et al. describe various positive displacement flow meter and pump apparatus utilizing one or more helical rotors. Another example of a helical-rotor volumetric flow meter is the Birotor™ line of positive displacement flow meters produced by Brooks Instrument, assignee of the present invention.

In helical-rotor fluid displacement apparatus such as flow meters or pumps, the dynamic characteristics of the rotors can significantly affect performance of the apparatus. For example, it is generally desirable for a helical-rotor flow meter used in petroleum flow metering applications have a rugged structure, low vibration levels, low pressure drop, wide operational flow range and high reliability. Each of these characteristics can be affected by the mechanical configuration of the helical-rotors in the apparatus. Certain rotor configurations, including some used in the conventional apparatus referred to above, may limit performance or exhibit reduced reliability. Accordingly, there is a continuing need for improved helical-rotor fluid displacement apparatus.

SUMMARY OF THE INVENTION

In light of the foregoing, it is an object of the present invention to provide improved helical-rotor positive displacement apparatus.

It is another object of the present invention to provide positive displacement flow meter apparatus with enhanced operational flow range, reduced vibration and increased reliability.

It is yet another object of the present invention to provide improved helical rotors for use in positive displacement apparatus such as volumetric flow meters or pumps.

These and other objects, features and advantages are provided according to the present invention by positive displacement apparatus including a housing defining a chamber in which parallel first and second helical rotors are meshed. Each of rotors includes a cylindrical body portion with a helical groove therein, and a helical tooth portion extending radially from the cylindrical body portion and running adjacent the helical groove. Preferably, a first tooth surface (e.g., a leading surface) lies in the helical groove and extends onto the helical tooth portion, and a second tooth surface (e.g., a trailing surface) extends away from the cylindrical body portion and onto the helical tooth portion, opposite the first tooth surface, with the first tooth surface defining an epitrochoid curve in radial cross section and the second tooth surface defining an epicycloid curve in radial cross section. The housing preferably has an inner surface that conforms to a boundary of a swept volume defined by the meshed rotors, forming a capillary seal between portions of third tooth surfaces of the rotors and the inner surface of the housing. This capillary seal, in conjunction with a capillary seal supported between meshed portions of the tooth portions of the rotors, defines a displacement volume that moves parallel to the axes of the rotors as the rotors turn. Clearances between the rotors are preferably maintained by meshed first and second timing gears that are coaxially mounted at ends of respective ones of the first and second rotors.

Rotor forms provided according to the present invention can provide improved dynamic performance, which in turn can provide advantageous operating characteristics in devices in which the rotors are used. For example, a rotor form according to the present invention can offer higher maximum rotational speed, reduced vibration and higher swept volume per revolution in comparison to conventional designs. These advantageous characteristics can mean higher throughput, lower pressure drop and wider operational flow range in devices such as flow meters.

In particular, according to one embodiment of the present invention, a fluid displacement apparatus includes a housing defining a chamber therein having a first port and a second port. First and second helical rotors with opposing pitches are meshed within the chamber, in fluid communication with the first and second ports. A respective one of the first and second helical rotors includes a cylindrical body portion having a helical groove therein and a helical tooth portion extending radially from the cylindrical body portion adjacent the helical groove. The first and second helical rotors are arranged such that respective longitudinal axes of the first and second helical rotors are parallel to one another and a helical tooth portion of one of the first and second helical rotors engages a helical groove of another of the first and second helical rotors, such that the first and second helical rotors are operative to rotate within the chamber and provide fluid transport between the first and second ports parallel to the longitudinal axes.

In another embodiment according to the present invention, a respective one of the first and second helical rotors has a first tooth surface lying within the helical groove and extending onto the helical tooth portion and a second tooth surface extending from the cylindrical body portion onto the helical tooth portion opposite the first tooth surface. The first tooth surface preferably includes an epitrochoid-derived surface, i.e., a surface defining an epitrochoid curve in radial cross section. The second tooth surface preferably includes an epicycloid-derived surface, i.e., a surface defining an epicycloid curve in radial cross section.

According to another embodiment of the present invention, the cylindrical body portion defines a pitch circle in radial cross section. The first tooth surface defines, in radial cross section, a compound curve including two opposing hypocycloid segments extending from a hub portion of the cylindrical body portion to the pitch circle and a first epicycloid segment extending radially from the pitch circle. The second tooth surface defines, in radial cross section, a second epicycloid segment extending radially from the pitch circle, opposite the first epicycloid segment.

In yet another embodiment of the present invention, rotation of the first and second rotors defines a swept volume, and the housing includes an inner surface conforming to a boundary of the defined swept volume. Opposing portions of the first and second helical rotors and portions of the third tooth surfaces confronting the inner surface of the housing may define a displacement volume that moves parallel to the axes of the first and second rotors as the first and second helical rotors rotate within the chamber. A respective one of the first and second helical rotors may include a third tooth surface disposed between the first and second tooth surfaces. The first and second helical rotors are preferably arranged such that portions of the third tooth surfaces are spaced apart from the inner surface of the chamber a distance that supports a capillary seal between portions of the third tooth surfaces and the inner surface of the chamber. The first and second rotors also are preferably arranged such that a capillary seal is supported between opposing portions of the first and second helical rotors. Respective first and second meshed timing gears may be attached to ends of the first and second rotors, and may maintain a first clearance between the third tooth surfaces and the inner surface of the chamber and to maintain a second clearance between opposing portions of the first and second helical rotors, the clearances supporting capillary seals.

Another aspect of the present invention relates to a fluid displacement apparatus including a housing defining a chamber therein having a first port and a second port, and a helical rotor mounted within the chamber and operative to rotate about a longitudinal axis, providing fluid transport between the first and second ports parallel to the longitudinal axis of the helical rotor. The helical rotor includes a cylindrical body portion disposed around the longitudinal axis and having a helical groove therein and a helical tooth portion extending radially from the cylindrical body portion and disposed adjacent the helical groove. A first tooth surface lies within the helical groove and extends onto the helical tooth portion, and a second tooth surface extends from the cylindrical body portion onto the helical tooth portion opposite the first tooth surface. The first tooth surface defines an epitrochoid curve in radial cross section and the second tooth surface defines an epicycloid curve in radial cross section.

According to yet another aspect of the present invention, a rotor for use in a fluid displacement apparatus includes a cylindrical body portion having a helical groove therein, and a helical tooth portion disposed adjacent the helical groove and extending radially from the cylindrical body portion. Preferably, a first tooth surface lies within the helical groove and extends onto the helical tooth portion and a second tooth surface extends from the cylindrical body portion onto the helical tooth portion opposite the first tooth surface, the first tooth surface defining an epitrochoid curve in radial cross section and the second tooth surface defining an epicycloid curve in radial cross section. The cylindrical body portion preferably defines a pitch circle in radial cross section. The first tooth surface preferably defines, in radial cross section, a compound curve including two opposing hypocycloid segments extending from a hub portion of the cylindrical body portion to the pitch circle and a first epicycloid segment extending radially from the pitch circle. The second tooth surface preferably defines, in radial cross section, a second epicycloid segment extending outward from the pitch circle, opposite the first epicycloid segment. Improved fluid displacement apparatus may thereby be provided.

DETAILED DESCRIPTION OF EMBODIMENTS

Figure 1:
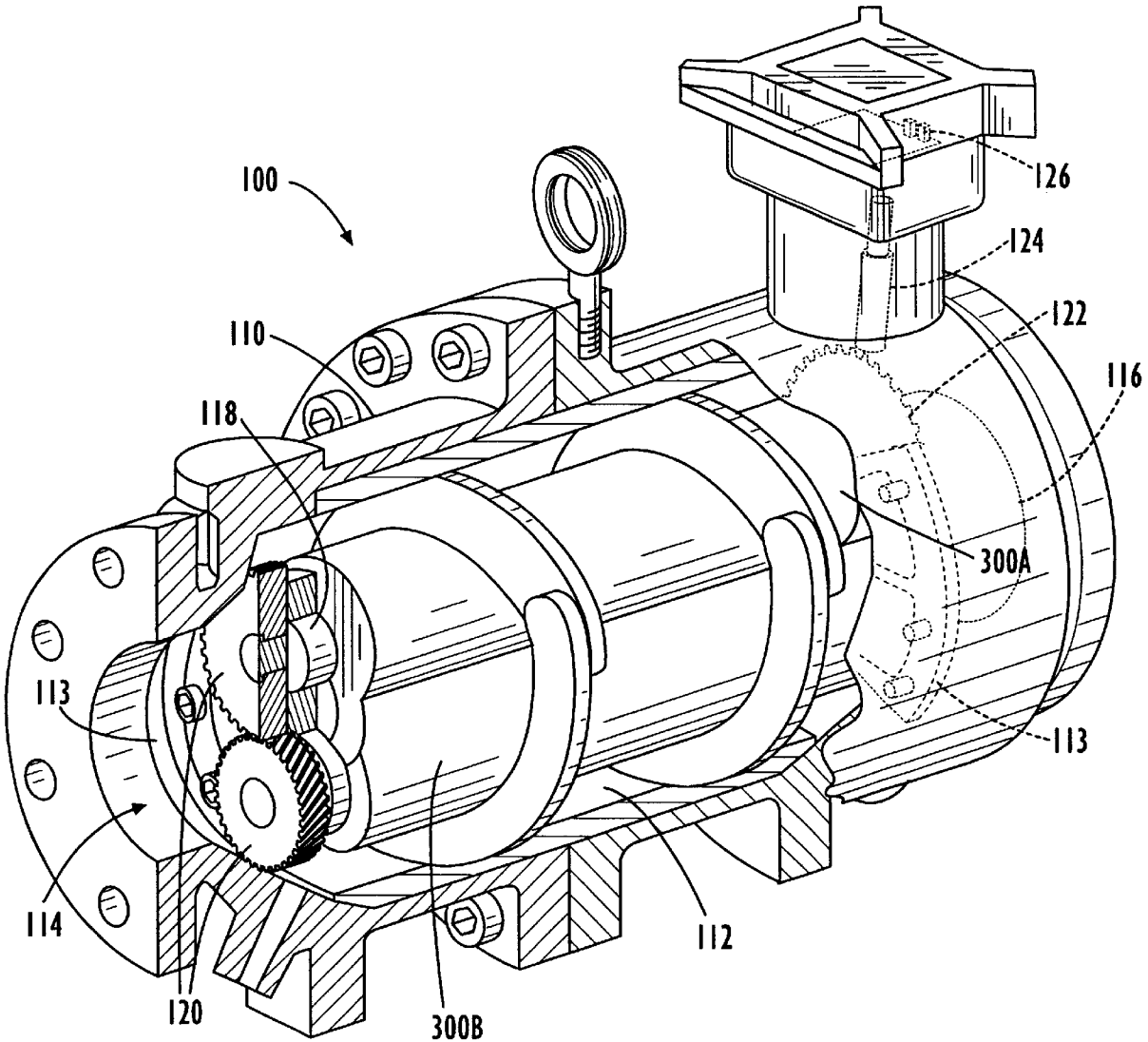
FIG. 1 is a cutaway perspective view of a positive-displacement flow meter apparatus according to an embodiment of the present invention.
Figure 2:
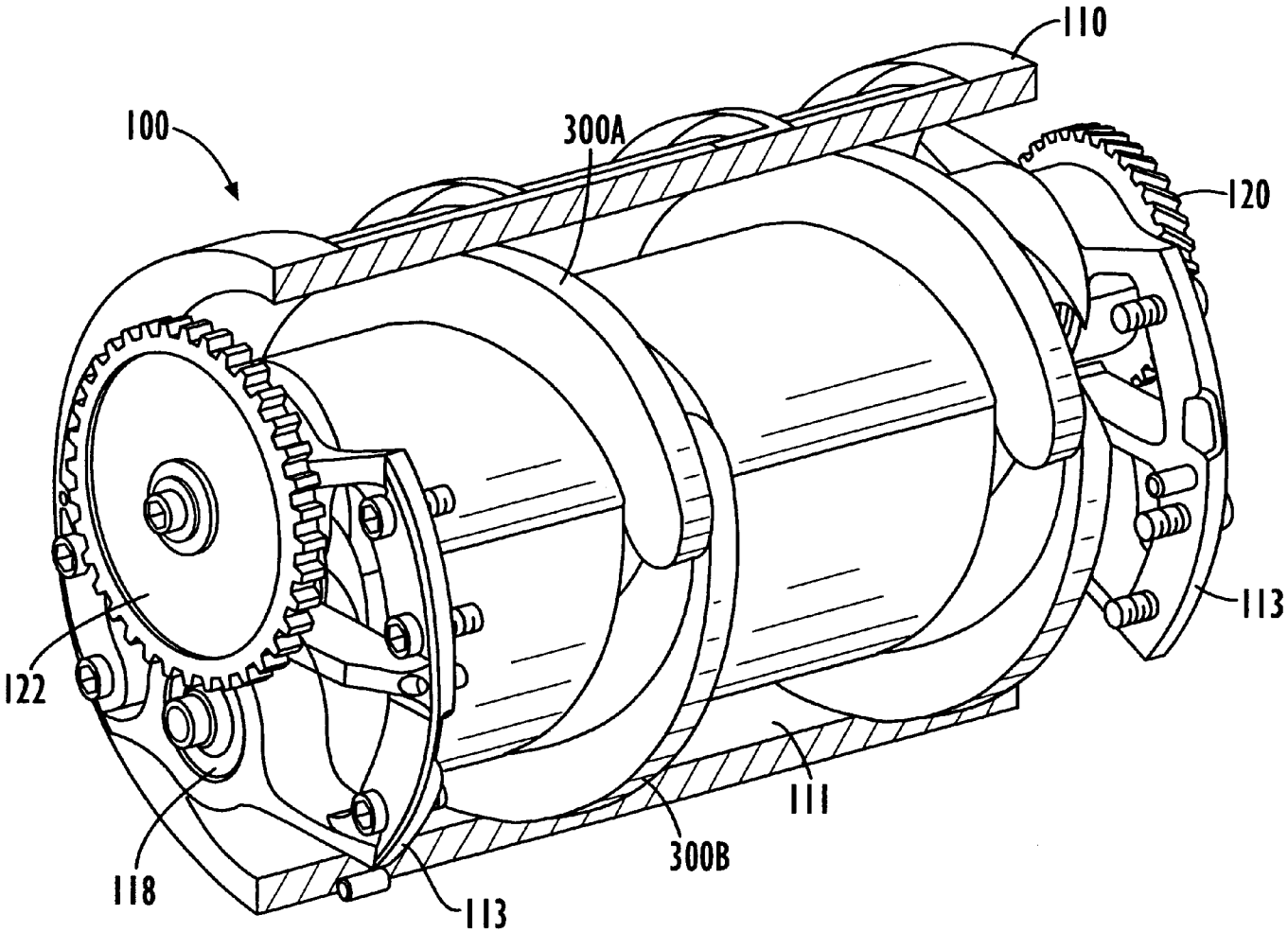
FIG. 2 is a cutaway perspective view of a displacement chamber for the flow meter apparatus of FIG. 1.
Figure 3A:
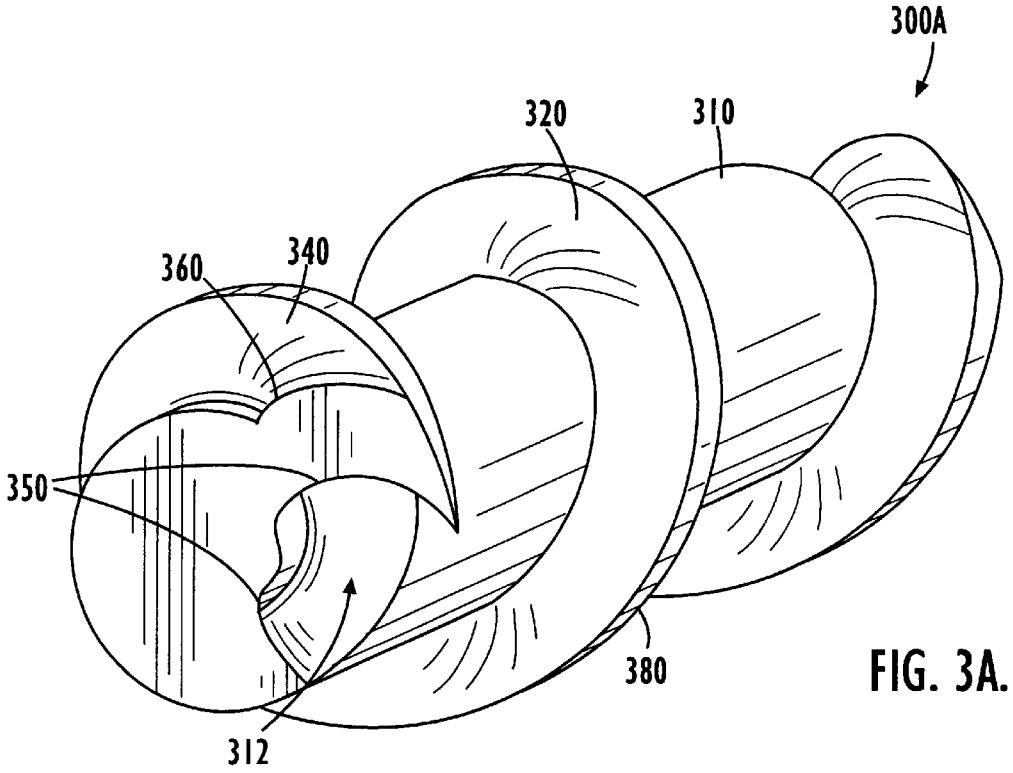
FIGS. 3A–3B are perspective views illustrating exemplary rotor structures according to embodiments of the present invention.
Figure 3B:
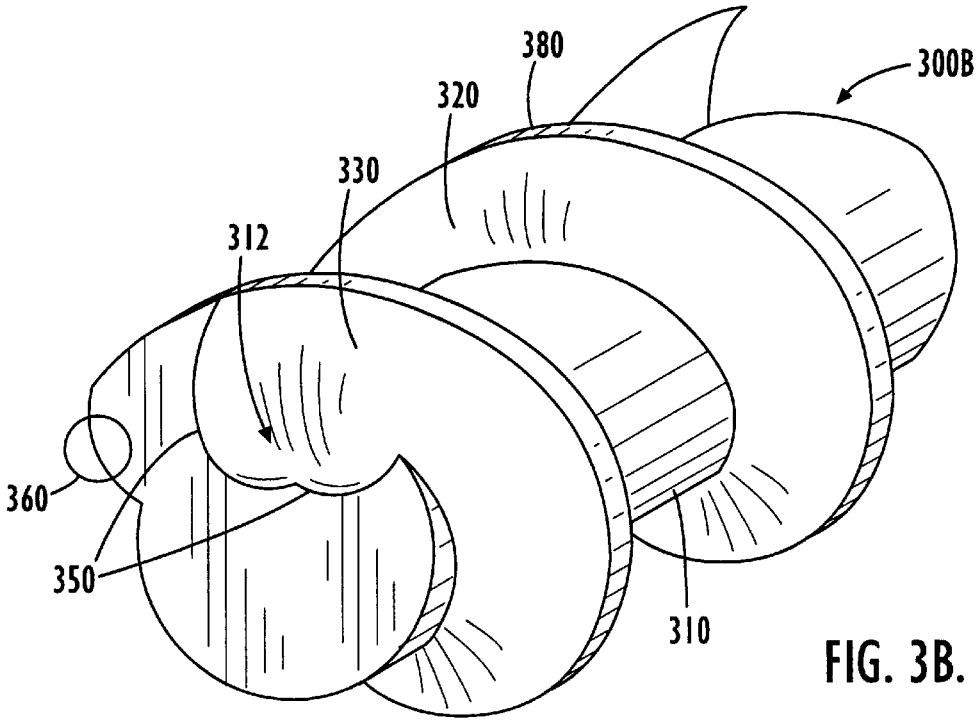

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Embodiments of the present invention will now be described, in particular, positive displacement flow meter apparatus such as may be used in petroleum metering and similar applications. However, those skilled in the art will appreciate that apparatus according to the present invention are not limited to the embodiments described in detail herein. Apparatus according to the present invention are also applicable to a variety of other fluid displacement applications, such as in positive displacement pumps.

FIGS. 1–3 and 7 illustrate a positive-displacement flow meter apparatus 100 according to an embodiment of the present invention. A housing 110, including end plates 113, defines a chamber 112. The chamber 112 has first and second ports 114, 116 that are operative to receive a fluid into the chamber 112 and to discharge a fluid from the chamber 112, respectively. The ports 114, 116 may be configured to receive and transport fluids from a pipeline or similar fluid transport structure. A pair of parallel helical rotors 300A, 300B with opposing pitches are meshed within the chamber 112, in fluid communication with the ports 114, 116.

Each of the rotors 300A, 300A is supported by end bearings 118 mounted in the end plates 113, and the rotors 300A, 300B are arranged such that longitudinal axes 301A, 301B of the rotors 300A, 300B are parallel to one another. A respective one of the rotors 300A, 300B includes a cylindrical body portion 310 from which a helical tooth portion 320 radially extends. The cylindrical body portion 310 has a helical groove 312 therein, running adjacent the helical tooth portion 320. The rotors 300A, 300B are arranged such that a helical tooth portion 320 of one of the rotors engages a helical groove 312 of the other of the rotors. Timing gears 120 may be coaxially attached to the rotors 300A, 300B to maintain clearances between the rotors 300A, 300B, and between the rotors 300A, 300B and an inner surface 111 of the housing 110. It will be understood that the timing gears 120 may keep the rotors 300A, 300B from touching one another and causing wear but, in some applications, the timing gears 120 may not be necessary.

A fluid pressure differential applied between the ports 114, 116 causes the rotors 300A, 300B to rotate about the axes 301A, 301B, transporting fluid between the ports 114, 116 in a direction parallel to the axes 301A, 301B. Preferably, tight clearances between opposing portions of the rotors 300A, 300B (as shown at 302 in FIG. 7) and between the opposing portions of the rotors 300A, 300B and the inner surface 111 (as shown at 303 in FIG. 7) are maintained as the rotors 300A, 300B turn. These clearances preferably are such that moving capillary seals are formed between the rotors 300A, 300B and between the rotors 300A, 300B and the inner surface 111, defining a series of displacement volumes 190 that move parallel to the axes 301A, 301B and separating flow between the ports 114, 116 into discrete volumetric units. By knowing the displacement volume and counting each displacement volume that passes through the meter 100 per unit time, flow rate between the ports 114, 116 can be determined.

Specifically, volumetric throughput may be determined by measuring rotation of one of the rotors 300A, 300B as a fluid flows between the ports 114, 116, as the rotors 300A, 300A displace a predetermined volume of fluid with each rotation. A flow rate signal representing flow through the flow meter 100 may be generated by a magnetic sensor 124, e.g., a Hall effect sensor, positioned adjacent a toothed wheel 122 coaxially attached to one of the rotors 300A, 300B. As the toothed wheel 122 rotates, the sensor 124 generates a pulse signal that is processed by a signal processing circuit 126 to produce a flow rate signal.

FIGS. 3A–3B and 6–7 illustrate structural details of exemplary rotors 300A, 300B. Each of the rotors 300A, 300B includes a cylindrical body portion 310 from which a helical tooth portion 320 radially extends. The cylindrical body portion 310 has a helical groove 312 therein, running adjacent the helical tooth portion 320. A first (e.g., leading) tooth surface 330 lies within the helical groove 312 and extends onto the helical tooth portion 320. A second (e.g., trailing) tooth surface 340 extends from the cylindrical body portion 310 onto the helical tooth portion 320, opposite the first tooth surface 330. The first tooth surface 330 preferably is an epitrochoid-derived surface, i.e., the first tooth surface 330 preferably defines an epitrochoid curve 350 in radial cross section. The second tooth surface 340 preferably is an epicycloid derived surface, i.e., the second tooth surface 340 preferably defines an epicycloid curve 360 in radial cross section. A third tooth surface 380 is disposed between the first and second tooth surfaces 330, 340, and is configured to confront the inner surface 111 of the housing 110 illustrated in FIGS. 1 and 2.

Figure 4:
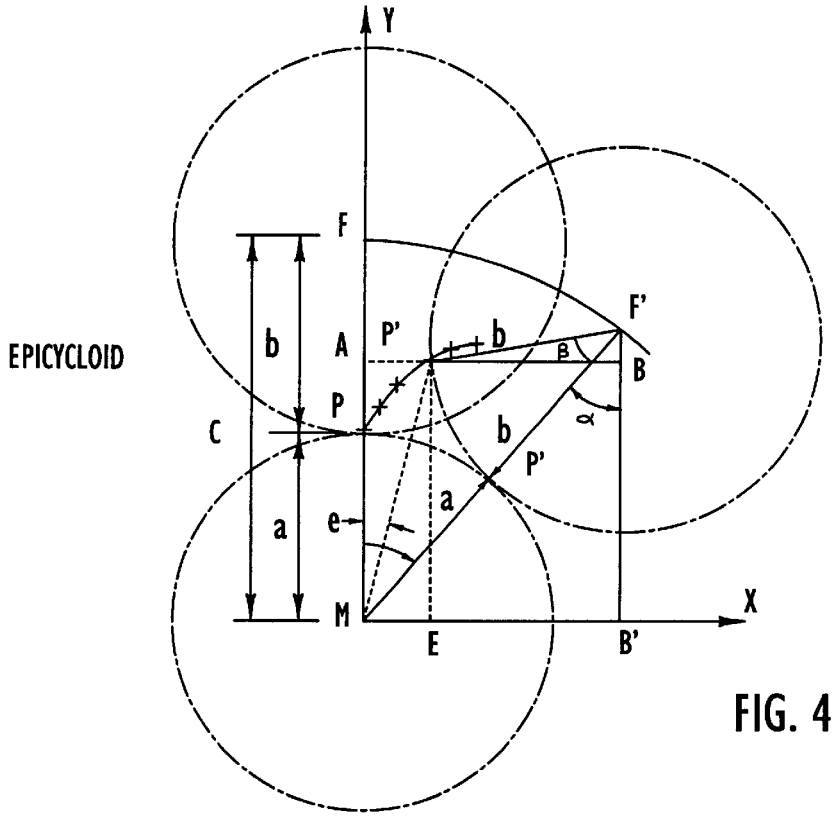
FIGS. 4–5 are graphs illustrating respective epicycloid and epitrochoid curves.
Figure 5:
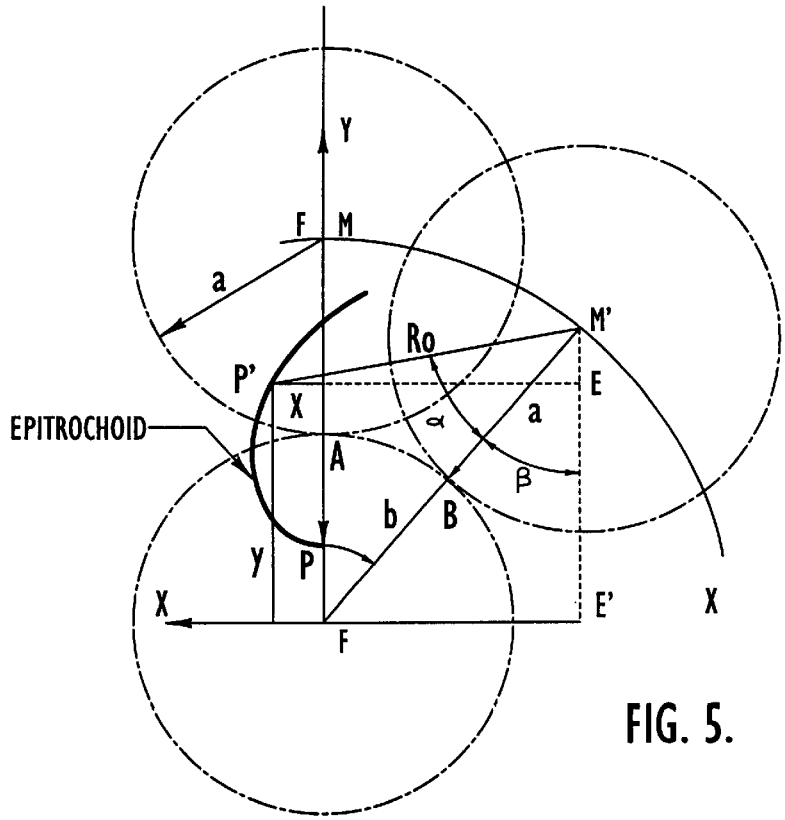

FIGS. 4 and 5 conceptually illustrate the nature of epicycloid and epitrochoid curves, respectively. An epicycloid curve is a curve traced by a point on the circumference of a circle that rolls without slippage on the outside of a fixed circle. Referring to FIG. 4, point M is the center of the fixed circle of radius a and the origin of the system of the coordinate axes X and Y. Point F is the center of the rolling circle of radius b, and point P is the contact between circles M and F. If the circle F is allowed to roll to the position F', then the contact will be at point P' and the point P on the circumference of circle F will be at P". This contact point travels through the angle α on the fixed circle and through the angle β on the rolling circle, and the coordinates of the point P" which is on the epicycloid are designated by x and y.

The following geometric relations apply to FIG. 4:

$$AP''=MB'-EB',$$

and $$EP''=B'F'-BF.'$$

In terms of trigonometric relations $$x=(a+b)\sin(\alpha)-b\sin(\alpha+\beta), \tag{1a}$$

and $$y=(a+b)\cos(\alpha)-b\cos(\alpha+\beta). \tag{1b}$$

If the circle rolls without slipping, then the arc PP' equals the arc P"P' or $$a\alpha=b\beta \tag{2}$$

Designating the ratio of the radius of the fixed circle to the radius of the rolling circle as k so that $$k=a/b, \tag{3}$$

then from equation (2)

$$\beta=k\alpha. \tag{4}$$

Substituting the above into equations (1a) and (1b), noting that the center distance C is $$C=a+b, \tag{5}$$

two general equations for the epicycloid may be obtained in the form $$x=C\,[\sin(\alpha)-1/(1+k)\sin(1+k)\alpha], \tag{6a}$$

and $$y=C\,[\cos(\alpha)-1/(1+k)\cos(1+k)\alpha]. \tag{6b}$$

For the special case when the ratio k=1 and the center distance C=1.000 inches, 1+k=2 and, from equations (6a) and (6b)

$$X=\sin(\alpha)-(½)\sin(2)\alpha, \tag{7a}$$

and $$y=\cos(\alpha)-(½)\cos(2)\alpha. \tag{7b}$$

An epitrochoid curve is a curve traced by a point on the radius of an outer rolling circle at a fixed distance from its center. Referring to FIG. 5, point F is the center of the fixed circle of radius b and the origin of the system of the coordinate axes X and Y. Point M is the center of the rolling circle of radius a and a point generating an epitrochoid curve is at the fixed distance $R_o$ If the circle M is allowed to roll over the circle F from point A to B, then the point at radius $R_o$ will trace an epitrochoid at PP'.

From FIG. 5, $$x=P'E-FE', \tag{8a}$$

and $$y=M'E'-M'E. \tag{8b}$$

In trigonometric terms $$x=R_o\sin(\alpha+\beta)-(a+b)\sin\beta, \tag{9a}$$

and $$y=(a+b)\cos((\beta)-R_o\cos(\alpha+\beta), \tag{9b}$$

or $$x=C[(R_oC)\sin(\alpha+\beta)-\sin(\beta)], \tag{10a}$$

and $$y=C[\cos\beta-(R_oC)\cos(\alpha+\beta)], \tag{10b}$$

where C is center distance equal to a+b, and the relations between α and β are obtained from the condition that the circle roll on each other without slipping.

Figure 6:
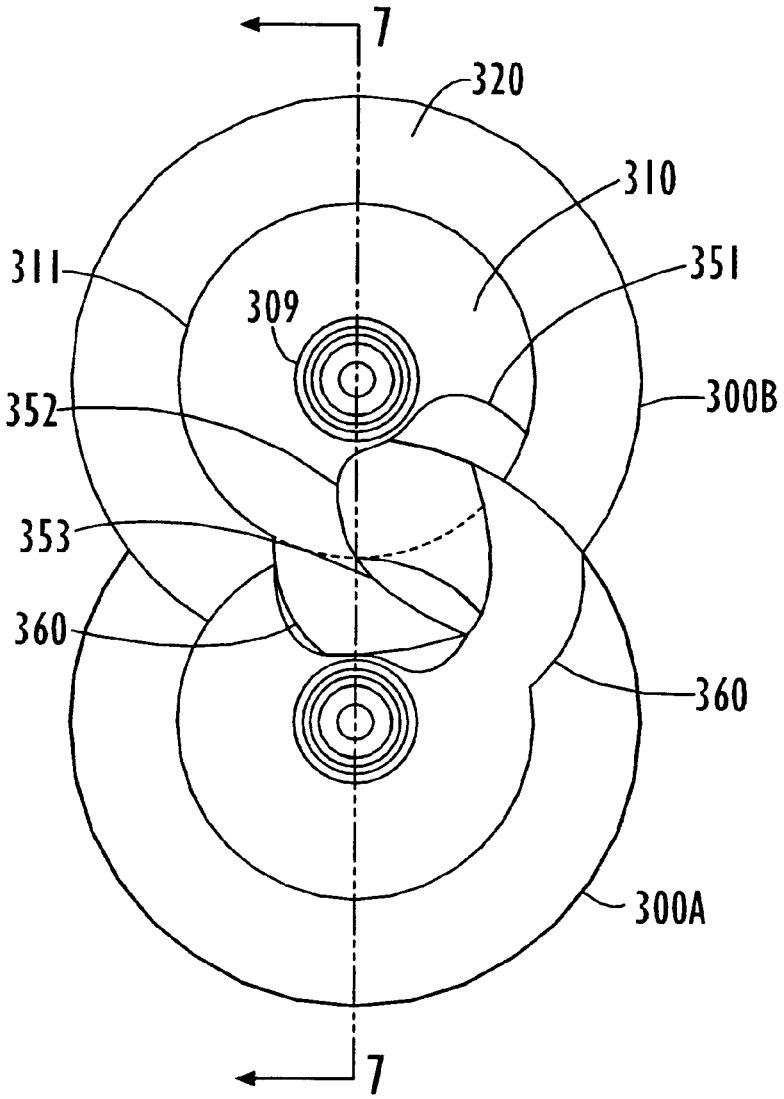
FIG. 6 is radial cross-sectional view of a pair of meshed helical rotors according to an embodiment of the present invention.

An alternative conceptualization of rotor forms according to the present invention may be described with reference to FIG. 6, which shows a radial cross-sectional view of helical rotors 300A, 300B. Referring to FIG. 6 with continuing reference to FIGS. 1–3 and 7, the cylindrical body portion 310 of the rotors 300A, 300B defines a pitch circle 311 in radial cross-section. In radial cross-section, the first tooth surface 330 defines a compound curve including opposing hypocycloid segments 351, 352 that extend from a hub portion 309 of the cylindrical body portion 310 to the pitch circle 311, and an epicycloid segment 353 extending radially from the pitch circle 311. In radial cross section, the second tooth surface 340 defines an epicycloid curve 360 that extends radially from the pitch circle 311.

As can be seen from FIG. 6, the rotors 300A, 300B have a great deal of their mass located within the pitch circle 311, thus causing the center of mass of the rotors 300A, 300B to be closer to the hub portion 309 than in many conventional rotor designs. This causes the rotors 300A, 300B to have lower angular momentum and to require less energy to rotate than many conventional rotor designs. The balanced design can also reduce vibration and increase bearing life. In addition, the rotors 300A, 300B have a relatively low cross-sectional area and, consequently, occupy a relatively low volume in comparison to conventional designs. The lower rotor volume means that the rotors can sweep a relatively larger fluid volume per revolution, resulting in higher volumetric throughput per revolution.

Figure 7:
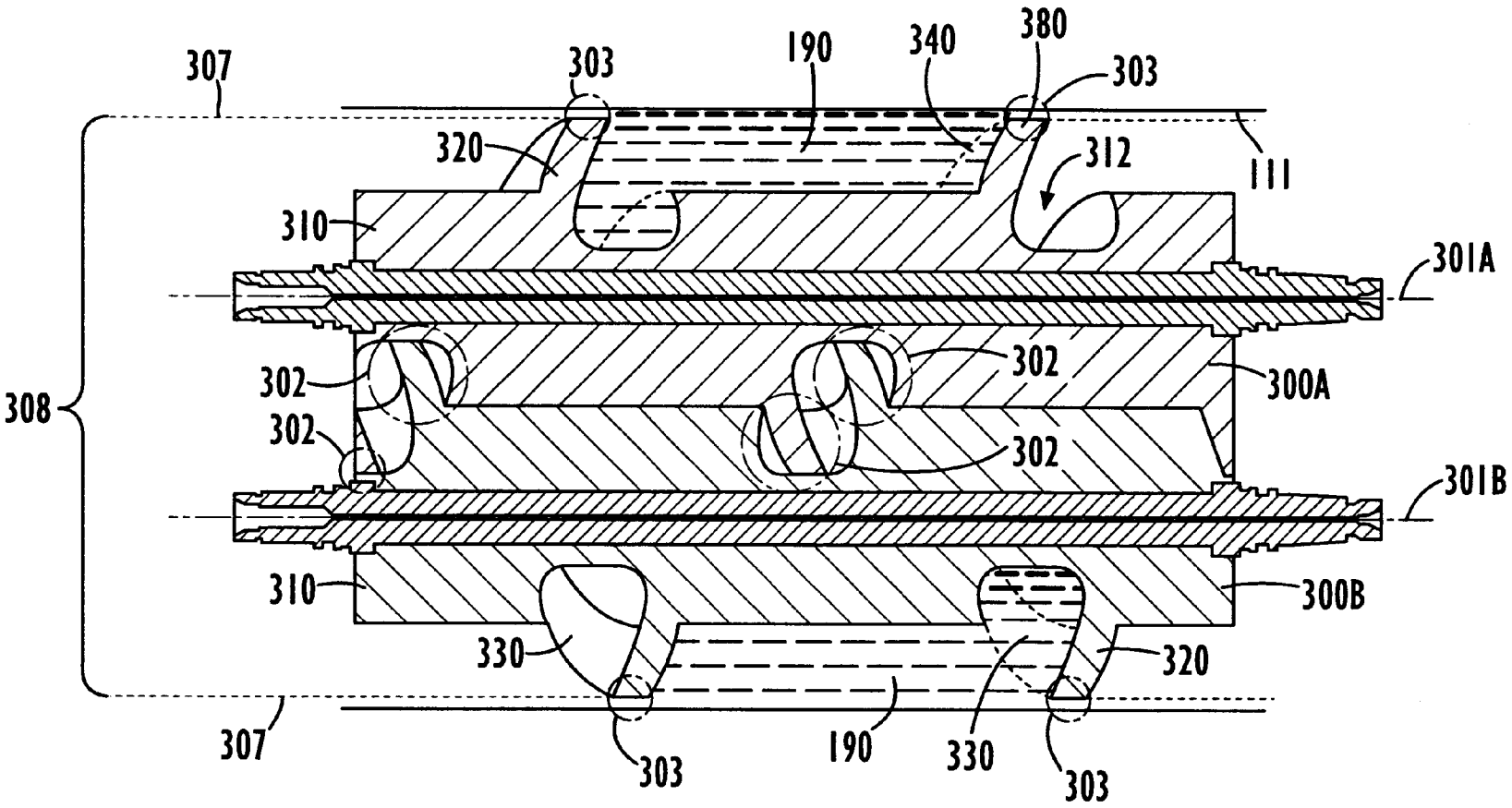
FIG. 7 is an axial cross-sectional view of a pair or meshed helical rotors according to an embodiment of the present invention.

FIG. 7 illustrates rotors 300A, 300B in axial cross-section, in particular, an axial cross-section along the line 7 illustrated in FIG. 6. Referring to FIG. 7 with continuing reference to FIGS. 1–3, the inner surface 111 of the housing 110 is configured to conform with a boundary 307 of a swept volume 308 defined by rotation of the rotors 300A, 300B. Preferably, clearances are maintained between a third tooth surface 380 and the inner surface 111 such that a capillary seal may be supported therebetween. In addition, the rotors 300A, 300B are aligned such capillary seals are supported between opposing portions of the rotors 300A, 300B. The capillary seals define a displacement volume 190 that moves parallel to the axes of the rotors 300A, 300B as the rotors 300A, 300B turn.

Figure 8:
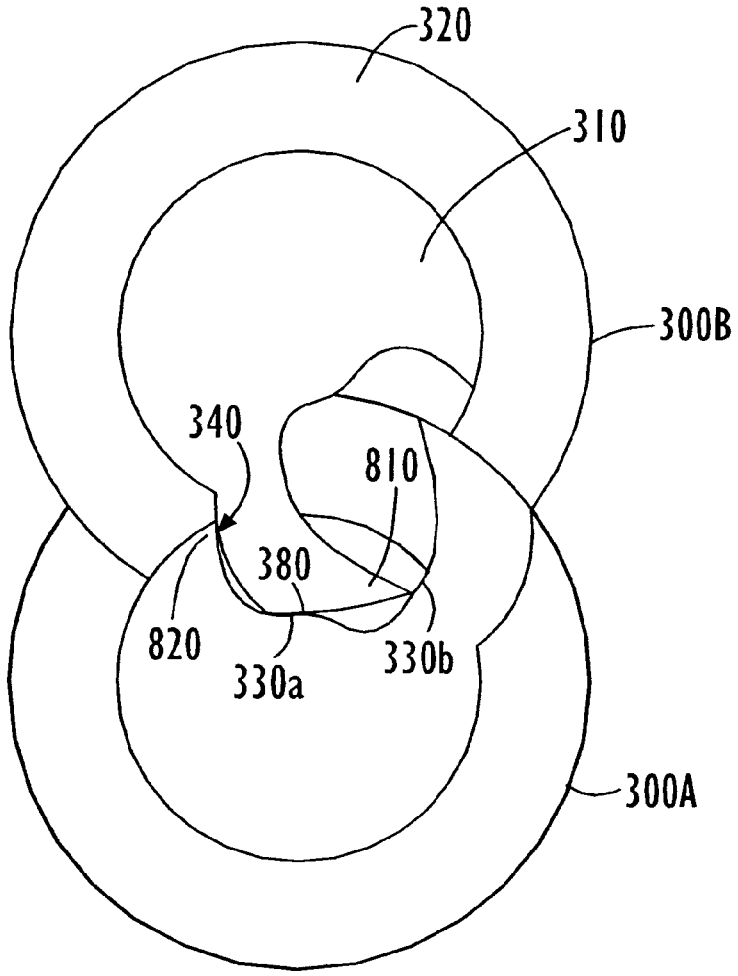
FIG. 8 is a radial cross-sectional view of a pair of meshed helical rotors according to an embodiment of the present invention.

FIG. 8 illustrates exemplary seal locations according to an embodiment of the present invention. For the exemplary embodiment, a capillary seal may be formed where a first portion 330*a* of the epitrochoid-derived tooth surface 330 (illustrated in FIGS. 3 and 7)of a first rotor 300A opposes surface 380 of a second rotor 300B. Other capillary seals may be formed where the epicycloid derived surface 340 of the second rotor 300B opposes a first portion 820 of the first rotor 300A, and where a second portion 300*b* of the epitrochoid derived surface 330 opposes a second portion 810 of the first rotor 300A. Preferably, clearances are maintained at these locations to prevent wear of the rotors 300A, 300B, while supporting the aforementioned capillary sealing. It will be appreciate that, as the rotors 300A, 300B turn, the capillary seals described above generally are dynamic, moving parallel to the axes of the rotors as the rotors turn.

Those skilled in the art will appreciate that the present invention is not limited illustrated embodiments of FIGS. 1–2, 3A–3B and 6–7, as many variations to these configurations fall within the scope of the present invention. For example, although the rotors 300A, 300B illustrated in FIGS. 1–2, 3A–3B, and 7 extending for 2 turns (or 720 degrees of helix rotation), other lengths and numbers of turns may be used with the present invention, and portions of the rotors 300A, 300B may depart from the illustrated geometries. For example, the tooth surfaces 380 of the rotors 300A, 300B may be reduced in size such that these surfaces are nearly or completely eliminated (i.e., such that the segments 353, 360 of FIG. 7 meet at a point).

Those skilled in the art will also appreciate that the housing 110 and the chamber 112 defined therein may have a number of different configurations. For example, the housing 110 may be constructed in a different manner than the two-piece structure illustrated in FIG. 1, and different port arrangements, end plate configurations, and the like may be used. Those skilled in the art will also appreciate that the manner in which a flow rate signal is generated may be generated in a number of other ways than the manner described above. For example, instead of using a magnetic transducer that detects movement of a toothed surface, other mechanical linkages and rotational transducers, such as synchros or optical encoders, may be utilized.

In the drawings and specification, there have been disclosed typical preferred embodiments of the invention and, although specific terms are employed, they are used in a generic and descriptive sense only and not for purposes of limitation, the scope of the invention being set forth in the following claims.

That which is claimed is:

1. A fluid displacement apparatus, comprising:

a housing defining a chamber therein having a first port and a second port; and first and second helical rotors with opposing pitches meshed within said chamber in fluid communication with said first and second ports, said first and second helical rotors each respectively comprising:

a cylindrical body portion having a helical groove therein; and a helical tooth portion extending radially from said cylindrical body portion adjacent said helical groove, wherein said first and second helical rotors are arranged such that respective longitudinal axes of said first and second helical rotors are parallel to one another and a helical tooth portion of one of said first and second helical rotors engages a helical groove of another of said first and second helical rotors, such that said first and second helical rotors are operative to rotate within said chamber and provide fluid transport between said first and second ports parallel to said longitudinal axes, and wherein each of said first and second helical rotors has a first tooth surface lying within said helical groove and extending onto said helical tooth portion and a second tooth surface extending from said cylindrical body portion onto said helical tooth portion opposite said first tooth surface, said first tooth surface defining an epitrochoid curve in radial cross section and said second tooth surface defining an epicycloid curve in radial cross section.

2. An apparatus according to claim 1:

wherein said cylindrical body portion defines a pitch circle in radial cross section;

wherein said first tooth surface defines, in radial cross section, a compound curve comprising two opposing hypocycloid segments extending from a hub portion of the cylindrical body portion to said pitch circle and a first epicycloid segment extending radially from said pitch circle; and wherein said second tooth surface defines, in radial cross section, a second epicycloid segment extending radially from said pitch circle, opposite said first epicycloid segment.

3. An apparatus according to claim 1:

wherein rotation of said first and second rotors define a swept volume; and wherein said housing comprises an inner surface conforming to a boundary of said defined swept volume.

4. An apparatus according to claim 3, wherein a respective one of said first and second helical rotors comprises a third tooth surface disposed between said first and second tooth surfaces.

5. An apparatus according to claim 4, wherein said first and second helical rotors are arranged such that portions of said third tooth surfaces are spaced apart from said inner surface of said chamber a distance that supports a capillary seal between portions of said third tooth surfaces and said inner surface of said chamber.

6. An apparatus according to claim 4, wherein said first and second rotors are arranged such that a capillary seal is supported between opposing portions of said first and second helical rotors.

7. An apparatus according to claim 4, wherein opposing portions of said first and second helical rotors and portions of said third tooth surfaces confronting said inner surface of said housing define a displacement volume that moves parallel to said axes of said first and second rotors as said first and second helical rotors rotate within said chamber.

8. An apparatus according to claim 4, further comprising:

a first timing gear attached to a first end of said first rotor; and a second timing gear attached to a first end of said second rotor and meshed with said first timing gear.

9. An apparatus according to claim 8, wherein said first and second timing gears are operative to align said first and second helical rotors and maintain a capillary seal between said third tooth surfaces and said inner surface of said chamber and a capillary seal between opposing portions of said first and second helical rotors.

10. An apparatus according to claim 8, wherein said first and second timing gears are operative to maintain a first clearance between said third tooth surfaces and said inner surface of said chamber and to maintain a second clearance between opposing portions of said first and second helical rotors.

11. An apparatus according to claim 1, further comprising a flow rate determiner operatively associated with at least one of said first and second helical rotors and operative to determine a flow rate of a fluid passing between said first and second ports responsive to rotation of said at least one of said first and second rotors.

12. An apparatus according to claim 11, wherein said flow rate determiner comprises:

a toothed wheel attached to an end of one of said first and second rotors;

a magnetic sensor adjacent a toothed surface of said toothed wheel and operative to produce a pulse signal as said toothed wheel rotates; and a signal processing circuit responsive to said magnetic sensor and operative to generate a flow rate indication signal from said pulse signal.

13. A fluid displacement apparatus, comprising:

a housing defining a chamber therein and having a first port and a second port; and a helical rotor mounted within said chamber and operative to rotate about a longitudinal axis, providing fluid transport between said first and second ports parallel to said longitudinal axis of said helical rotor, said helical rotor comprising:

a cylindrical body portion disposed around said longitudinal axis and having a helical groove therein; and a helical tooth portion extending radially from said cylindrical body portion and disposed adjacent said helical groove, wherein a first tooth surface lies within said helical groove and extends onto said helical tooth portion and a second tooth surface extends from said cylindrical body portion onto said helical tooth portion opposite said first tooth surface, said first tooth surface defining an epitrochoid curve in radial cross section and said second tooth surface defining an epicycloid curve in radial cross section.

14. An apparatus according to claim 13:

wherein said cylindrical body portion defines a pitch circle in radial cross section;

wherein said first tooth surface defines, in radial cross section, a compound curve comprising two opposing hypocycloid segments extending from a hub portion of the cylindrical body portion to said pitch circle and a first epicycloid segment extending radially from said pitch circle; and wherein said second tooth surface defines, in radial cross section, a second epicycloid segment extending radially from said pitch circle, opposite said first epicycloid segment.

15. An apparatus according to claim 13, wherein said helical rotor comprises parallel-arranged first and second helical rotors having opposing pitches, meshed within said chamber.

16. An apparatus according to claim 15, wherein rotation of said first and second helical rotors defines a swept volume, and wherein said housing includes an inner surface conforming to a boundary of said swept volume.

17. An apparatus according to claim 16, further comprising:

a first timing gear attached to a first end of said first rotor; and a second timing gear attached to a first end of said second rotor and meshed with said first timing gear, wherein said first and second timing gears are operative to align said first and second helical rotors and maintain a first clearance between said third tooth surfaces and said inner surface of said chamber and to maintain a second clearance between opposing portions of said first and second helical rotors.

18. A rotor for use in a fluid displacement apparatus, the rotor comprising:

a cylindrical body portion having a helical groove therein; and a helical tooth portion disposed adjacent said helical groove and extending radially from said cylindrical body portion, wherein a first tooth surface lies within said helical groove and extends onto said helical tooth portion and a second tooth surface extends from said cylindrical body portion onto said helical tooth portion opposite said first tooth surface, said first tooth surface defining an epitrochoid curve in radial cross section and said second tooth surface defining an epicycloid curve in radial cross section.

19. A rotor according to claim 18:

wherein said cylindrical body portion defines a pitch circle in radial cross section;

wherein said first tooth surface defines, in radial cross section, a compound curve comprising two opposing hypocycloid segments extending from a hub portion of the cylindrical body portion to said pitch circle and a first epicycloid segment extending radially from said pitch circle; and wherein said second tooth surface defines, in radial cross section, a second epicycloid segment extending radially from said pitch circle, opposite said first epicycloid segment.

20. A rotor according to claim 18, wherein a third tooth surface is disposed between said first and second tooth surfaces.

21. A rotor according to claim 18, wherein said helical tooth portion is configured to mesh with a helical tooth portion of rotor having an opposite pitch.

22. A fluid displacement apparatus, comprising:

a housing defining a chamber therein having a first port and a second port; and first and second helical rotors meshed within said chamber in fluid communication with said first and second ports, said first and second rotors comprising respective mirror-image first and second helical rotor portions that each respectively comprise:

a cylindrical body portion having a helical groove therein; and a helical tooth portion extending radially from said cylindrical body portion adjacent said helical groove, wherein said first and second helical rotor portions are arranged such that respective longitudinal axes of said first and second helical rotor portions are parallel to one another and a helical tooth portion of one of said first and second helical rotor portions engages a helical groove of another of said first and second helical rotor portions, such that said first and second helical rotor portions are operative to rotate within said chamber and provide fluid transport between said first and second ports parallel to said longitudinal axes, and wherein each of said first and second helical rotor portions has a first tooth surface lying within said helical groove and extending onto said helical tooth portion and a second tooth surface extending from said cylindrical body portion onto said helical tooth portion opposite said first tooth surface, said first tooth surface defining an epitrochoid curve in radial cross section and said second tooth surface defining an epicycloid curve in radial cross section.

23. An apparatus according to claim 22:

wherein said cylindrical body portion defines a pitch circle in radial cross section;

wherein said first tooth surface defines, in radial cross section, a compound curve comprising two opposing hypocycloid segments extending from a hub portion of the cylindrical body portion to said pitch circle and a first epicycloid segment extending radially from said pitch circle; and wherein said second tooth surface defines, in radial cross section, a second epicycloid segment extending radially from said pitch circle, opposite said first epicycloid segment.

24. A fluid displacement apparatus, comprising:

a housing defining a chamber therein having a first port and a second port; and first and second helical rotors meshed within said chamber in fluid communication with said first and second ports, said first and second rotors comprising respective mirror-image first and second helical rotor portions that each respectively comprise:

a cylindrical body portion having a helical groove therein; and a helical tooth portion extending radially from said cylindrical body portion adjacent said helical groove, wherein said first and second helical rotor portions are arranged such that respective longitudinal axes of said first and second helical rotor portions are parallel to one another and a helical tooth portion of one of said first and second helical rotor portions engages a helical groove of another of said first and second helical rotor portions, such that said first and second helical rotor portions are operative to rotate within said chamber and provide fluid transport between said first and second ports parallel to said longitudinal axes, and wherein rotation of said first and second rotors defines a swept volume; and wherein said housing comprises an inner surface conforming to a boundary of said defined swept volume.

25. An apparatus according to claim 24, wherein a respective one of said first and second helical rotors comprises a third tooth surface disposed between said first and second tooth surfaces.

26. An apparatus according to claim 25, wherein said first and second helical rotors are arranged such that portions of said third tooth surfaces are spaced apart from said inner surface of said chamber a distance that supports a capillary seal between portions of said third tooth surfaces and said inner surface of said chamber.

27. An apparatus according to claim 25, wherein said first and second helical rotors are arranged such that a capillary seal is supported between opposing portions of said first and second helical rotor portions.

28. An apparatus according to claim 25, wherein opposing portions of said first and second helical rotor portions and portions of said third tooth surfaces confronting said inner surface of said housing define a displacement volume that moves parallel to said axes of said first and second rotors as said first and second helical rotors rotate within said chamber.

* * * * *